United States Patent [19]

Horvath et al.

[11] 4,067,701

[45] Jan. 10, 1978

[54] GRINDING MACHINE FOR CARBIDE CUTTING ELEMENTS

[75] Inventors: Frank P. Horvath, Owosso; J. Robert Appleby, Corunna, both of Mich.; William J. Morris, deceased, late of Flint Township, Genessee County, Mich., by Charles F. Morris, administrator

[73] Assignee: Neway Manufacturing, Inc., Corunna, Mich.

[21] Appl. No.: 637,119

[22] Filed: Dec. 3, 1975

[51] Int. Cl.[2] ..... B24B 3/00

[52] U.S. Cl. ..... 51/33 R; 76/12

[58] Field of Search ..... 51/33 R, 99, 92 ND; 76/12, 22, 40, 43, 24 R

[56] References Cited

U.S. PATENT DOCUMENTS

| | | | |
|---|---|---|---|
| 1,777,135 | 9/1930 | Bailey | 76/24 R |
| 2,212,999 | 8/1940 | Faulder | 76/12 X |
| 2,375,703 | 5/1945 | Swartzwelder | 51/33 R |
| 2,552,164 | 5/1951 | Foss | 51/33 R |
| 2,761,251 | 9/1956 | Konkel | 51/33 R |
| 2,807,914 | 10/1957 | Pascal | 51/33 R |
| 3,178,857 | 4/1965 | Grob | 51/33 R |
| 3,349,645 | 10/1967 | Silvey | 76/40 |

*Primary Examiner*—Harold D. Whitehead
*Assistant Examiner*—Nicholas P. Godici
*Attorney, Agent, or Firm*—Blanchard, Flynn, Thiel, Boutell & Tanis

[57] ABSTRACT

A grinding machine particularly for grinding the teeth on a carbide cutter. The machine includes a carriage swingably mounted on a frame for oscillation about a pivot axis. The carriage has a grinding wheel mounted thereon and rotatably driven by a motor which is also mounted on the carriage. The wheel is rotatable about an axis which is approximately parallel to but spaced from the pivot axis. A feeding mechanism projects outwardly from the front face of the grinding wheel at an angle of approximately 45° relative to the rotational axis. The feeding mechanism releasably supports a carbide element. The feeding mechanism is linearly advanced toward the grinding wheel in an intermittent steplike movement which is synchronized with the oscillating movement of the carriage so that the grinding wheel cuts a groove across the carbide element during both the forward and return swings of the carriage. The grooves cut in the carbide element form cutting teeth therebetween, which teeth have a rounded convex configuration due to the engagement of the carbide element with the grinding wheel at a location between the pivot and rotational axes.

14 Claims, 11 Drawing Figures

GRINDING MACHINE FOR CARBIDE CUTTING ELEMENTS

FIELD OF THE INVENTION

This invention relates to a grinding machine which is capable of automatically forming a plurality of cutting teeth on a carbide element.

BACKGROUND OF THE INVENTION

The refinishing of valve seats on an internal combustion engine is normally accomplished utilizing either a grinding wheel or a valve cutter employing a plurality of carbide cutting elements. This latter technique, and specifically the equipment for permitting refinishing of the valve seats, is disclosed in U.S. Pat. Nos. 3,354,528 and 3,391,604. The use of this latter-mentioned technique, namely the employment of carbide cutting elements having a plurality of teeth thereon for refinishing a valve seat, is particularly desirable since it is believed to result in a more uniform refinishing of the valve seat, while permitting the refinishing to be performed in a more efficient manner. Further, with the increased usage of nonleaded fuel in vehicle engines, the higher temperatures encountered in the engines require that the valve seats be made of even harder materials so that refinishing of the valve seats becomes even more difficult, which in turn makes the use of carbide cutters (in contrast to grinding) much more attractive for the refinishing of the valve seats. However, the use of valve seat reconditioning equipment employing carbide cutters has been restricted by the difficulty in manufacturing the carbide cutters. These carbide cutters, prior to the present invention, have been conventionally manufactured on an individualized and manual basis. That is, the cutting of the grooves required that the cutter be manually moved and reclamped in the desired position so as to permit each groove to be ground in the cutter. This is obviously extremely time consuming and laborious, and in addition prevents the cutters and particularly the teeth thereon from having a high degee of uniformity in view of the tolerances and errors introduced by the manual manipulations. The carbide cutters produced by this technique have thus not only possessed a degree of nonuniformity, but have also been extremely costly. This has also prevented the manufacture of cutters on a mass scale.

Accordingly, the present invention relates to an improved grinding machine for permitting the automatic manufacture of carbide cutters of this type, which machine overcomes the disadvantages associated with the prior manufacturing techniques explained above. More specifically, the present invention relates to an improved grinding machine for permitting the substantially automatic forming of carbide cutters which not only have a higher degree of uniformity, but which can be manufactured more efficiently and at a much more rapid rate.

The object of the present invention, namely an improved grinding machine as aforesaid, is accomplished by providing a grinding machine with a swingable carriage having a rotatable grinding wheel supported thereon, which grinding wheel is rotatable about an axis which is spaced from the pivot axis of the carriage. A feeding mechanism supplies a carbide element into a grinding region whereby the element is cut by the grinding wheel so as to form grooves thereacross. The feeding mechanism, which moves the element at an angle of approximately 45° relative to the rotational axis of the grinding wheel, advances the element toward the grinding wheel with an intermittent steplike movement which is synchronized with the swinging movement of the carriage. The grinding wheel swings across the element and forms a groove therein, whereupon the element is then stepped forward a preselected amount so that the next swinging movement of the grinding wheel causes the formation of a further substantially parallel groove therein, whereby a cutting tooth is formed between adjacent grooves. This process is continued until the selected surface of the element has a plurality of teeth formed thereon.

Other objects of the invention will be apparent to persons familiar with this technology upon reading the following specification and inspecting the accompanying drawings.

Figure 1:
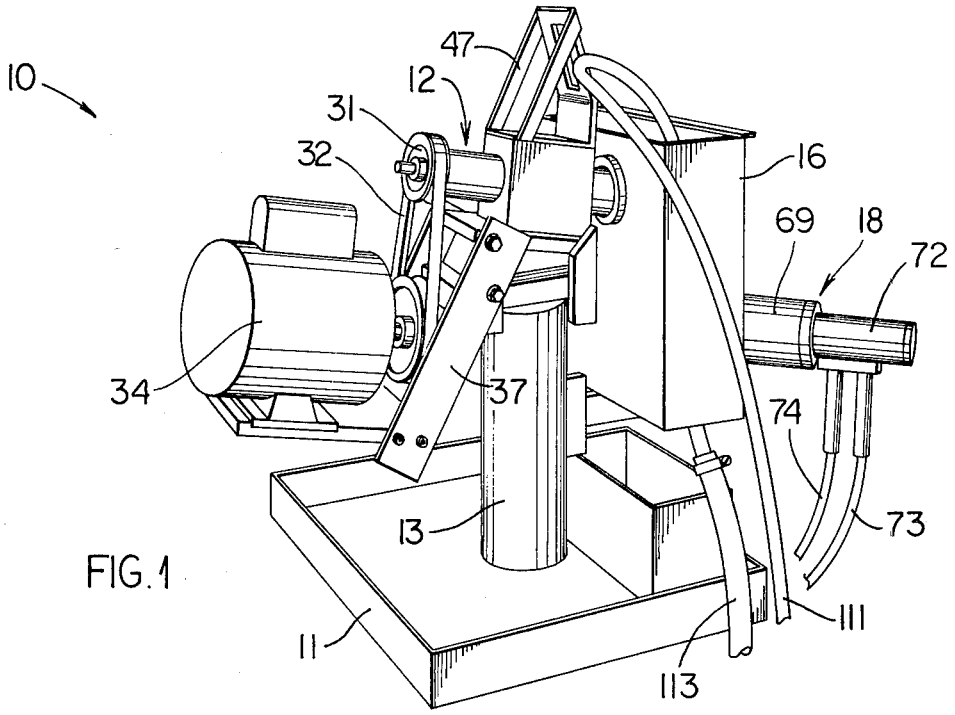
FIG. 1 is a perspective view of the improved grinding machine.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the machine and designated parts thereof. The word "front" will refer to the right side of the machine as appearing in FIG. 2. Said terminology will include the words specifically mentioned, derivatives thereof and words of similar import.

SUMMARY OF THE INVENTION

The objects and purposes of the present invention are met by providing a grinding machine wherein a carriage is swingably mounted on a frame for angular oscillation about a pivot axis which extends substantially horizontally. A grinding wheel is rotatably supported on the carriage for rotation about an axis which is approximately parallel to but radially spaced from the pivot axis. The motor for the grinding wheel is also preferably mounted on the carriage and oscillates therewith. A further drive device is connected to the carriage for controlling the oscillation thereof. A feed mechanism, which supports a carbide element to be ground, is disposed adjacent the front face of the grinding wheel and extends at an acute angle relative to the rotational axis. The feed mechanism has a power unit associated therewith which causes the carbide element to be moved into a position wherein it is engaged by the periphery of the grinding wheel during the swinging movement of the carriage. The feed mechanism causes the carbide element to be moved forward in an intermittent steplike manner which is synchronized with the oscillation of the carriage so that the grinding wheel sequentially moves back and forth over the carbide element and sequentially forms a plurality of parallel grooves therein, which grooves define cutting teeth therebetween. The carbide element is fed into a region located between the pivot and rotational axes, whereby the grinding wheel forms teeth having a rounded convex configuration in the longitudinal direction thereof.

DETAILED DESCRIPTION

Figure 2:
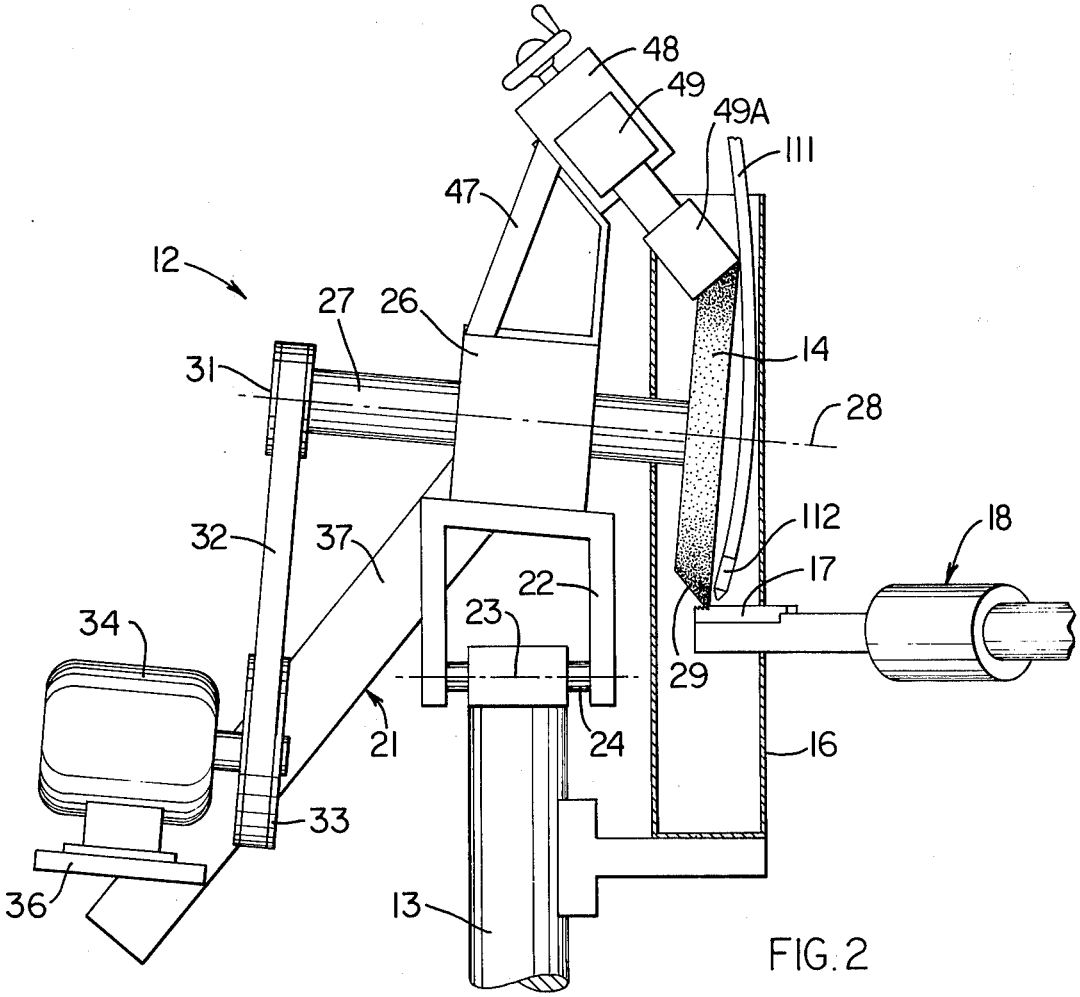
FIG. 2 is a fragmentary elevational view, partly in cross section, of the grinding machine.
Figure 9:
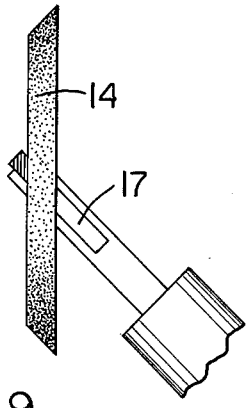
FIG. 9 diagramatically illustrates the angular relationship between the grinding wheel and the feed mechanism.

FIGS. 1 and 2 illustrate a grinding machine 10 according to the present invention, which machine includes a stationary frame 11 having a grinding unit 12 swingably mounted on the upper end of an upright pedestal 13 which forms a part of the frame 11. The grinding unit 12 includes a rotatable grinding wheel 14 which is surrounded by a protective boxlike shroud 16. The grinding wheel is adapted to engage an elongated barlike workpiece 17 associated with a feed mechanism 18 which moves the workpiece into the grinding region for engagement with the grinding wheel.

The grinding unit 12 comprises a carriage 21 which is swingably mounted on the frame 11. The carriage 21 has a yoke member 22 pivotally supported for rotation about a substantially horizontal axis 23, which axis is defined by a pivot shaft 24 mounted on the upper end of the pedestal 13. A bearing support 26 is mounted on the yoke 22 and rotatably supports an elongated spindle 27, which spindle has the axis 28 thereof extending approximately horizontally and approximately parallel with the pivot axis 23. The axes 23 and 28 are disposed within a common plane but the axis 28, in the illustrated embodiment, extends at a small angle relative to the axis 23, such as at an angle of approximately 10°.

The grinding wheel 14 is mounted on the forward end of the spindle 27, which wheel preferably comprises a diamond-tipped carbide wheel having a tapered cutting edge 29 which extends at an angle of approximately 25° relative to the front face of the wheel.

A driven pulley 31 is fixedly secured to the rearward end of spindle 27 and is driven by a belt 32 which is disposed in engagement with a driving pulley 33. The pulley 33 is secured to the drive shaft of a motor 34, such as a conventional electric motor, which motor in turn is mounted on a pedestal 36 fixedly secured to a pair of arms 37 which comprise a part of the swingable carriage 21.

Figure 3:
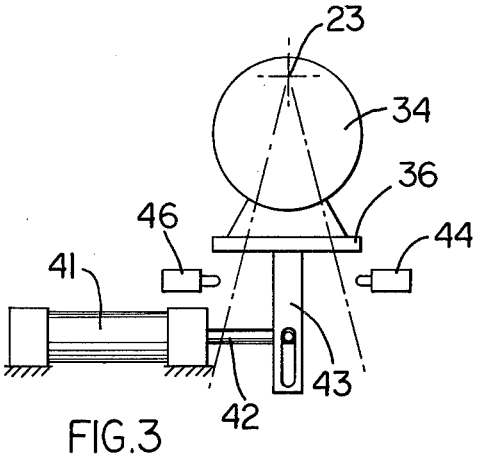
FIG. 3 is a diagramatic view of the drive mechanism for the swingable carriage.

The carriage 21 is swingably moved back and forth about the pivot axis 23 by a power device which comprises a double-acting fluid pressure cylinder 41 (FIG. 3), preferably a hydraulic cylinder. The piston rod 42 of cylinder 41 is drivingly connected to a lever 43 which is fixed to the carriage 21 and projects downwardly from the pedestal 36. The alternate energization of cylinder 41 in opposite directions causes the carriage 21 to be angularly oscillated about the pivot axis 23 through an angle which has been diagramatically illustrated by dash-dot lines in FIG. 3, which angle extends approximately 30° on either side of the vertical. To cause reversal in the energization of the power cylinder 41, a pair of conventional electrical limit switches 44 and 46 are disposed for engaging the arm 43 and, through conventional electrical and hydraulic circuitry, cause reversal in the energization of the power cylinder 41 to thereby result in a repetitive and automatic oscillation of the carriage 21.

To permit redressing of the 25° angle on the grinding wheel 14, there is provided a bracket 47 (FIG. 2) mounted on the bearing support 26. This bracket is adapted to have a slide assembly 48 releasably mounted thereon, which slide assembly has a manual control wheel associated therewith for permitting an electric motor 49, which has a dressing wheel 49A associated therewith, to be moved downwardly so as to result in the dressing wheel 49A engaging the tapered cutting edge 29 to permit redressing thereof. This redressing structure can be completely removed from the bracket 47 during normal operation of the grinding machine.

Considering now the feed mechanism 18, and referring specifically to FIGS. 4–8, same is slidably supported on an elongated guide 51 which is normally maintained stationary relative to the machine frame. For this purpose, there is provided an elongated bracket 52 fixed to and projecting outwardly from the pedestal 13, which bracket has a flange 53 fixed to the outer end thereof. An adjustment screw 54 is threadably engaged with the bracket 52 adjacent the outer end thereof, which screw has the upper end thereof disposed for engagement with a plate member 56 which is fixed to and comprises a part of the guide 51. The screw 54 permits the vertical position of the guide 51 to be selectively adjusted, with the guide 51 being fixedly secured to this selected position by a screw 57 which is threadably engaged therewith and projects through a vertically elongated slot 58 formed in the flange 53.

The guide 51 slidably supports the feed mechanism 18 thereon so that the complete feed mechanism can thus be linearly slidably displaced in a horizontal direction. The feeding mechanism 18 includes an elongated slide 61 which is slidably supported on the guide 51 and is provided with guide flanges 62 fixed on opposite sides thereof, which guide flanges project downwardly so as to overlap the opposite sides of the guide 51. Slide 61 has a headed pin 63 mounted thereon and projecting downwardly through an elongated slot 64 formed in the guide 51. A nut 66 is threadably secured to the lower end of pin 63, and a spring 67 coacts between the nut 66 and a washer 68 which is disposed in slidable bearing engagement with the lower surface of the guide 51. This resilient connection maintains the slide 61 in engagement with the upper surface of the guide 51 while enabling the slide 61 to be slidably reciprocated in the longitudinal direction of the guide.

The slide 61 is fixedly connected to one end of a sleevelike connecting member 69, which member in turn is fixedly connected at the other end thereof to the housing 71 of a conventional rotary fluid motor 72. The fluid motor 72 is supplied with pressure fluid, normally hydraulic fluid, through conduits 73 and 74 so that the motor can be driven in opposite rotational directions. The fluid motor 72 has a rotatable output shaft 76 which projects into the connecting sleeve 69 and has an annular collar 77 nonrotatably keyed thereto. The collar 77 is engaged with an axially extending coupling pin 78 which projects into a small recess formed in the collar. The pin 78 is fixedly mounted on a coupling sleeve 79 which is rotatably supported on the connecting sleeve 69. The coupling sleeve 79 is nonrotatably keyed to the rearward end of an elongated screw 81, which screw has the forward end thereof disposed in threaded engagement with the rearward portion of the guide 51, which rearward portion functions as a stationary nut so as to act as a reaction member whereby rotation of the screw 81 causes the complete feed mechanism 18, including the motor 72 and the slide 61, to be slidably linearly displaced relative to the guide 51.

The slide 61 has a workpiece clamping device 83 mounted thereon, and for this purpose a bar 84 is fixedly secured to the upper surface of the slide 61, as by screws 86. The bar 84 supports a pivot shaft 87 which has the axis thereof extending substantially horizontally but perpendicularly with respect to the direction of movement of the slide 61. A leverlike workpiece supporting member 88 has the rearward end thereof clampingly engaged with one end of the pivot shaft 87 so that the supporting member 88 can be swingably moved between a grinding position as illustrated by solid lines in FIG. 5 and a release position as indicated by dotted lines in FIG. 5, which positions are spaced approximately 90° apart.

The upper surface of the supporting member 88 has a recess 89 (FIG. 8) formed therein adjacent the free end of the member, which recess is adapted to have an elongated barlike workpiece 17 positioned therein. A releasable clamping element 91 is mounted on the supporting member 88 and has the upper portion thereof cooperating with the recess 89 so as to permit the workpiece 17 to be fixedly clampingly mounted in a position to permit grinding thereof. A conventional thumb screw 92 mounts the clamping element 91 on the supporting member 88.

Figure 8:
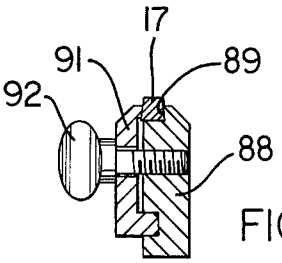

The workpiece 17, as shown in FIG. 8, preferably has a trapezoidal cross section, and the supporting member 88 and clamping element 91 similarly have opposed clamping surfaces thereon which are slightly tapered relative to one another to facilitate the clamping of the workpiece 17 within the recess 89. When clamped within the recess, the upper surface of the workpiece 17 projects above the supporting member 88 and clamping element 91 to permit a grinding operation to be performed thereon, as explained hereinafter.

Figure 5:
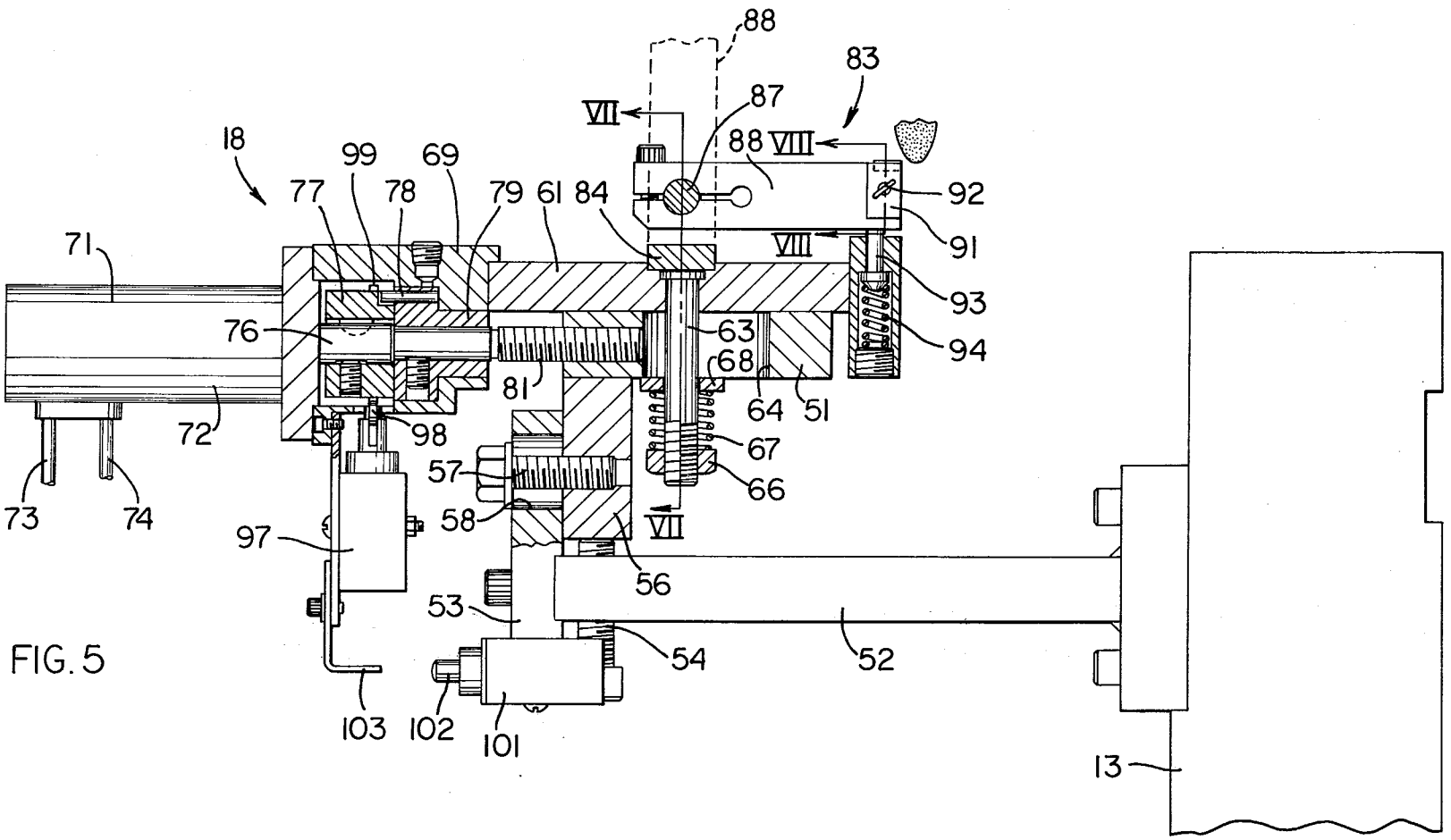
FIG. 5 is an enlarged elevational view, partially in cross section, of the feed mechanism.

The workpiece supporting member 88, when in the grinding position shown by solid lines in FIG. 5, has the lower surface thereof disposed in engagement with the upper end of a support pin 93, which pin is slidably supported on the slide 61 and is resiliently urged upwardly by a spring 94. The spring 94 normally maintains the pin 93 in engagement with a stop surface formed on the slide for limiting the upward position of the pin.

To permit movement of the workpiece supporting member 88 into its release position, as indicated by dotted lines in FIG. 5, there is provided a handle 96 fixedly secured to the other end of the pivot shaft 87. This handle 96 also functions as a counterweight to assist in maintaining the support member 88 in either of the two positions indicated in FIG. 5. The supporting member 88, when in the raised position indicated by dotted lines, is maintained in this position by means of a suitable stop (not shown) as mounted on the slide 61.

Figure 4:
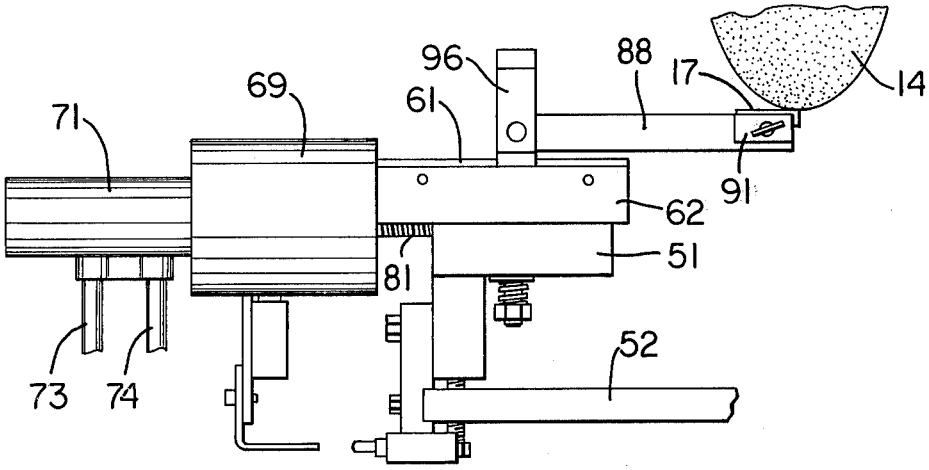
FIG. 4 is a diagramatic elevational view of the feed mechanism.
Figure 6:
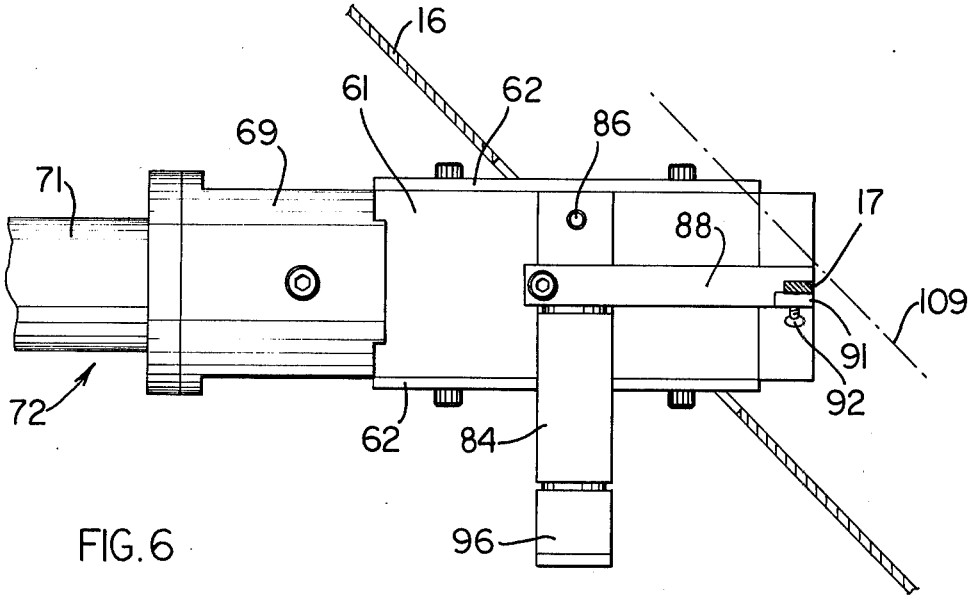
FIG. 6 is a fragmentary top view of FIG. 5.
Figure 7:
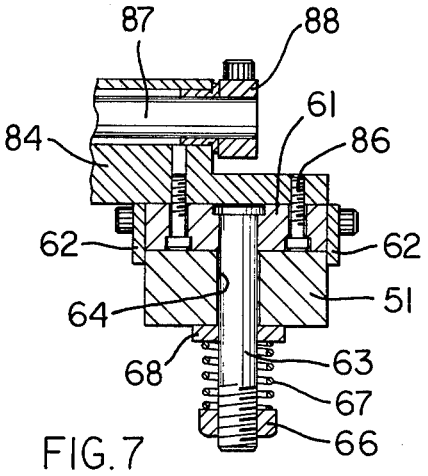
FIGS. 7 and 8 are sectional views along lines VII—VII and VIII—VIII, respectively, in FIG. 5.

When the workpiece 17 is to be fed into and through the grinding region, the fluid motor 72 is energized so as to cause the slide 61 to be moved inwardly toward the grinding region, which movement occurs in a rightward direction in FIGS. 4–6. The movement of the workpiece 17 through the grinding region occurs in an intermittent steplike manner which is synchronized with the oscillation of the grinding wheel. For controlling the intermittent energization of the fluid motor 72, there is provided a conventional micro or limit switch 97 (FIG. 5) mounted on a plate which is fixed to the connecting sleeve 69. The switch 97 has the actuator 98 thereof disposed for engagement with the outer periphery of the rotatable collar 77. This collar 77 has a pair of cam lobes 99 projecting outwardly therefrom, which lobes in the illustrated embodiment are on diametrically opposite sides of the collar and, when they engage the actuator 98, cause a de-energization of the motor 72 and hence a stoppage of the slide 61.

A further micro or limit switch 101 (FIG. 5) is mounted on the flange 53 and has the actuator 102 thereof disposed for engagement with a bracket 103. The bracket 103 engages the actuator 102 and causes activation of the switch 101 when the feed mechanism 18 has advanced forwardly a maximum extent, indicating that the complete upper surface of the workpiece 17 has been ground, whereupon the switch 101 deactivates the feed mechanism 18. The switch 101 also causes energization of a warning light (not shown) associated with a conventional control panel to thereby indicate to the operator that the grinding operation has been completed, whereupon the operator then manually activates a control switch on the panel which reversely energizes the fluid motor 72 and causes the complete feed mechanism 18 to be linearly moved outwardly (leftwardly in FIGS. 4–6) into its starting position.

Figure 11:
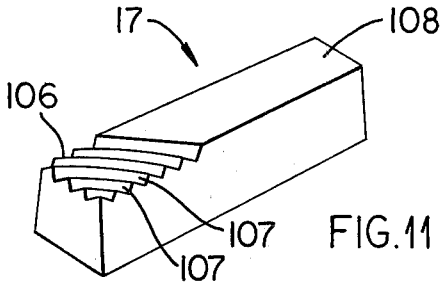
FIG. 11 is a perspective view of a partially formed carbide cutter.

Considering now the workpiece 17, and referring specifically to FIG. 11, same normally comprises an elongated barlike element preferably constructed on tungsten carbide, whereby the workpiece is thus extremely hard. The workpiece generally has a trapezoidal-shaped cross section, as previously noted. To form this workpiece into a cutting element, same has the upper surface 108 thereof ground so as to form teeth 106, which teeth extend over the complete upper surface of the workpiece. For his purpose, grooves 107 are formed across the upper surface, as by means of the grinding machine according to the present invention, whereupon an appropriate cutting tooth 106 is thus formed between each adjacent pair of grooves. The grooves and teeth extend across the upper surface 108 at an angle of approximately 45° with respect to the longitudinally extending direction of the workpiece. The teeth 106 preferably have a rounded convex configuration when viewed in the longitudinal direction thereof so as to have an appropriate radius necessary to permit proper refinishing of a valve seat.

OPERATION

Figure 10:
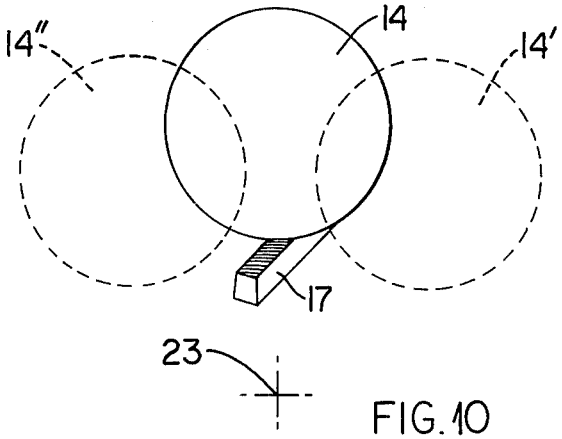
FIG. 10 diagramatically illustrates the grinding wheel when moving between its extreme angular positions.

Prior to initiating the grinding of a workpiece, the feed mechanism 18 is initially in the retracted position illustrated in FIG. 5, and the swingable carriage 21 is maintained in one of its extreme positions so that the grinding wheel 14 is likewise in in one of its end positions, such as the position 14' illustrated in FIG. 10. With the workpiece supporting member 88 in its upward position as indicated by dotted lines in FIG. 5, a blank workpiece 17 is positioned within the recess 89 and clampingly held therein, as by manual tightening of the thumb screw 92. The supporting member 88 is then manually swung downwardly into the grinding position indicated by solid lines in FIG. 5. The grinding machine is then in condition to initiate the grinding of a cutting element.

The operator then pushes a start switch which is located on the control panel (not shown), whereupon the pressure cylinder 41 is automatically and intermittently energized in opposite directions so as to swing the carriage back and forth between the limits defined by the limit switches 44 and 46, whereupon the grinding wheel 14 accordingly swings between the extreme positions indicated by 14' and 14'' in FIG. 10. Simultaneously with this swinging of the carriage, the motor 34 is also energized so that the grinding wheel 14 is accordingly continuously rotated about its axis 28.

During the back-and-forth swinging of the carriage 21 and of the grinding wheel 14 mounted thereon, the motor 72 is intermittently energized so as to cause the feed mechanism 18 and hence the workpiece 17 to be moved into and through the grinding region in an intermittent steplike manner. After each inward steplike movement of the workpiece, the grinding wheel 14 swingably moves across the top surface 108 of the workpiece and forms a groove 107 across the workpiece. The inward steplike movement of the workpiece, and the synchronized swinging movement of the grinding wheel, continues until the complete upper surface 108 has been traversed by the grinding wheel so as to form the grooves 107 thereacross, which grooves result in a plurality of teeth 106 being formed on the workpiece. After the grinding wheel has completely traversed the upper surface of the workpiece, the bracket 103 contacts the switch 101 which de-energizes the hydraulic motor 72 and also stops the pressure cylinder 41 so that the grinding wheel is maintained in one of the end positions 14' or 14''. The operator then manually presses a further switch on the control panel which energizes the fluid motor 72 in the reverse manner, whereupon the motor is continuously energized for a selected period of time so as to move the feed mechanism 18 outwardly and thereby retract the workpiece from the grinding region. When the feed mechanism reaches its outermost position, the operator then manually swings the support member 88 upwardly and releases the thumb screw 92 so as to remove the finished workpiece. A new blank workpiece is then clamped on the device and a new grinding cycle is initiated.

During the grinding of the workpiece, the steplike movement of the feed mechanism is synchronized with the swinging movement of the grinding wheel so that the grinding wheel will cut a single groove 107 across the upper surface 108 during both the forward and return swings thereof. For example, when the carriage 21 approaches one end of its swing so that the arm 43 thereof contacts the limit switch 44, in which position the grinding wheel is at 14'', the limit switch 44 will cause energization of the cylinder 41 so that the carriage 21 will then begin to swing in a reverse direction (counterclockwise as viewed in FIGS. 3 and 10). The limit switch 44 also causes a simultaneous energization of the fluid motor 72 whereupon this motor is rotated through approximately one-half turn until the cam lobe 99 actuates the limit switch 97 which deactivates the motor 72. However, during this one-half revolution of the output shaft 76, the slide 61 and the workpiece 17 are moved forwardly a preselected distance so that the workpiece is positioned so as to intersect the path of movement 109 formed by the cutting edge of the grinding wheel. This steplike advance of the workpiece 17 takes place prior to the grinding wheel being swung sufficiently so as to engage the workpiece. The swinging movement of the grinding wheel will cause it to pass over the upper surface of the workpiece and thus form the groove 107 thereacross. The grinding wheel will continue its swinging movement until the arm 43 engages the limit switch 46, which results in reverse energization of cylinder 41 so that the carriage and grinding wheel are now again swung in a clockwise direction. Simultaneous with this reversal in the oscillation of the carriage, motor 72 is again energized and steps the workpiece 17 forwardly through a further preselected distance so that the grinding wheel will now form a further groove 107 across the workpiece during its swinging movement. In this manner, the spacing between the grooves 107 can be precisely controlled due to the steplike advance provided by the feed mechanism 18, thereby resulting in the formation of uniform teeth 106. Further, the grinding of the teeth can be accomplished at an optimum rate since the grinding wheel cuts a groove across the workpiece during both the forward and rearward swinging movements thereof, the grinding wheel thus cutting two grooves in the workpiece during each complete cycle of oscillation.

Since the workpiece 17 is positioned to engage the grinding wheel at a location disposed between the pivot axis 23 and the rotational axis 28, this results in the grinding wheel oscillating across the workpiece substantially as illustrated in FIG. 10, which results in a complete rounding off of the upper surface of the workpiece and thereby provides the workpiece with rounded convex teeth.

While the present invention discloses specific power devices for driving the various elements of the grinding machine, such as the pressure cylinder 41 and the fluid motor 72, it will be appreciated that other types of power devices can be utilized for performing these functions. However, by using two hydraulic devices, such as the hydraulic cylinder 41 and the hydraulic motor 72, this simplifies the control of the overall machine since a common hydraulic circuit can be utilized for controlling both drive devices, which control is further simplified by the limit switches which control the movements of the machine and in turn provide the necessary control over the hydraulic circuitry, as by the use of conventional solenoid-controlled valves.

The embodiments of the invention in which an exclusive property or privilege is claimed are defined as follows:

1. A grinding machine for cutting a plurality of substantially parallel teeth along one side of a workpiece, comprising:

a frame;

a carriage swingably mounted on said frame for oscillation through a predetermined angle about a pivot axis;

drive means drivingly connected to said carriage for causing back-and-forth swinging of said carriage through said predetermined angle;

a grinding wheel supported on said carriage for rotation about a rotational axis which is spaced from said pivot axis;

a driving device drivingly connected to said grinding wheel for rotating same;

a support device for releasably supporting thereon a workpiece which is to be ground, said support device having clamping means for releasably holding said workpiece;

said frame including means supporting said support device for movement toward the grinding wheel so that said workpiece is positioned for engagement with said wheel at a location between said pivot and rotational axes, whereby oscillation of said carriage causes said grinding wheel to form a rounded convex surface on said workpiece;

a power device for moving said support device toward the grinding wheel for permitting grinding of said workpiece; and control means for causing said support device to be moved toward said grinding wheel in an intermittent steplike manner in synchronization with the oscillation of said grinding wheel, whereby said grinding wheel will sequentially form a plurality of substantially parallel grooves across said workpiece, which grooves define cutting teeth therebetween.

2. A grinding machine according to claim 1, wherein said control means advances said support device through a steplike distance during each reversal in the swinging direction of the carriage so that said grinding wheel cuts a new groove across said workpiece during each of the forward and rearward swings of the carriage.

3. A grinding machine according to claim 2, wherein said support device is movable along a direction which extends at an angle of approximately 45° relative to said rotational axis.

4. A grinding machine according to claim 2, wherein said rotational axis is approximately parallel with said pivot axis.

5. A grinding machine according to claim 4, wherein said support device is supported for movement toward said grinding wheel along a line of movement which extends at an angle of approximately 45° relative to the cutting plane defined by said grinding wheel.

6. A grinding machine according to claim 5, wherein said driving device includes motor means drivingly connected to said grinding wheel for rotating same, said motor means and said grinding wheel each being mounted on said carriage on substantially diametrically opposite sides of said pivot axis.

7. A grinding machine according to claim 2, wherein said power device comprises a fluid motor connected to said support device, and reaction means coacting between said fluid motor and said frame for causing said fluid motor and said support device to be moved as a unit relative to said frame in response to energization of said fluid motor.

8. A grinding machine according to claim 2, wherein said support device includes slide means slidably supported on the frame for movement toward the grinding wheel and a workpiece support member movably supported on said slide means and being manually movable between a first position permitting grinding of the workpiece and a second position permitting removal of the workpiece.

9. A grinding machine according to claim 1, wherein said pivot axis extends substantially horizontally, wherein said rotational axis is disposed within a plane which passes through said pivot axis, said rotational axis extending at an angle of approximately 10° relative to said pivot axis, wherein said grinding wheel has a tapered cutting edge formed on the periphery thereof so that said edge forms a V-shaped groove in the workpiece, wherein said predetermined angle is approximately 60°, and wherein said support device is movable toward said grinding wheel along a direction which extends at an angle of approximately 45° relative to a cutting plane as defined by said grinding wheel during its swinging movement.

10. A grinding machine for cutting a plurality of substantially parallel teeth along one side of a workpiece, comprising:

a frame;

a carraige swingably mounted on said frame for oscillation through a predetermined angle of approximately 60° about a pivot axis which extends substantially horizontally;

drive means drivingly connected to said carriage for causing back-and-forth swinging of said carriage through said predetermined angle;

a grinding wheel having a tapered cutting edge formed on the periphery thereof so that said edge forms a V-shaped groove in the workpiece, said grinding wheel being supported on said carriage for rotation about a rotational axis which is spaced from said pivot axis, said rotational axis being disposed within a plane which passes through said pivot axis, and said rotational axis extending at an angle of approximately 10° relative to said pivot axis;

a driving device drivingly connected to said grinding wheel for rotating same;

a support device for releasably supporting thereon a workpiece which is to be ground, said support device having clamping means for releasably holding said workpiece;

a power device for moving said support device toward the grinding wheel for permitting grinding of said workpiece, said support device being movable toward said grinding wheel along a direction which extends at an angle of approximately 45° relative to a cutting plane as defined by said grinding wheel during its swinging movement; and control means for causing said support device to be moved toward said grinding wheel in an intermittent steplike manner in synchronization with the oscillation of said grinding wheel, whereby said grinding wheel will sequentially form a plurality of substantially parallel grooves across said workpiece, which grooves define cutting teeth therebetween.

11. A grinding machine according to claim 10, wherein said control means synchronizes the energization of said drive means and said power device for causing said support device to be linearly and intermittently advanced toward the grinding wheel through a steplike distance during each reversal in the swinging direction of the carriage so that said grinding wheel cuts a new groove across the workpiece during each of the forward and rearward swings of the carriage.

12. A grinding machine for cutting a plurality of substantially parallel teeth along one side of a workpiece, comprising:

a frame;

a carriage swingably mounted on said frame for oscillation through a predetermined angle about a pivot axis which extends substantially horizontally;

drive means drivingly connected to said carriage for causing back-and-forth swinging of said carriage through said predetermined angle;

a grinding wheel supported on said carriage for rotation about a rotational axis which is spaced from said pivot axis and extends at a small angle relative thereto, said grinding wheel having peripheral edge means defining a tapered cutting edge capable of forming a V-shaped groove in said workpiece as said grinding wheel moves thereacross;

a driving device drivingly connected to said grinding wheel for rotating same;

a support device for releasably supporting thereon a workpiece which is to be ground, said support device being movable toward said grinding wheel along a direction which extends at an angle of approximately 45° relative to a cutting plane as defined by said grinding wheel during its swinging movement, said support device having clamping means for releasably holding said workpiece;

guide means associated with said frame for slidably supporting said support device thereon for linear movement in a direction which extends at an acute angle relative to the front face of the grinding wheel;

a power device for moving said support device linearly toward the grinding wheel for permitting grinding of said workpice; and control means coacting with said drive means and said power device for synchronizing the energization thereof and for causing said support device to be linearly and intermittently advanced toward the grinding wheel through a steplike distance during each reversal in the swinging direction of the carriage so that said grinding wheel cuts a new groove across the workpiece during the forward swing of the carriage and cuts a further new groove across said workpiece during the return swing of the carriage.

13. A grinding machine according to claim 12, including a boxlike shroud positioned in surrounding relationship to said grinding wheel, said shroud having a sidewall thereof positioned outwardly from the front face of the grinding wheel, said sidewall having opening means formed therein, and said support device projecting through said opening means whereby said workpiece is positioned for engagement with said grinding wheel.

14. A grinding machine for cutting a plurality of substantially parallel teeth along one side of a workpiece, comprising:

a frame;

a carriage swingably mounted on said frame for oscillation through a predetermined angle about a pivot axis;

drive means drivingly connected to said carriage for causing back-and-forth swinging of said carriage through said predetermined angle;

a grinding wheel supported on said carriage for rotation about a rotational axis which is spaced from said pivot axis, said grinding wheel having a cutting edge capable of forming a groove in said workpiece as said grinding wheel moves thereacross;

a driving device drivingly connected to said grinding wheel for rotating same;

a support device for releasably supporting thereon a workpiece which is to be ground, said support device including a slide member which is slidably supported on said frame for linear movement along a selected direction which extends at an acute angle relative to the front face of said grinding wheel;

said support device also including a workpiece holding member hingedly mounted on said slide member and swingable between first and second angularly spaced positions, said workpiece holding member when in said first position being disposed closely adjacent a forward end of said slide member so that said workpiece is positioned for engagement with said grinding wheel during the linear advance of said support device, said workpiece holding member when in said second position being swung outwardly away from said slide member for permitting a finished workpiece to be removed therefrom and a new workpiece to be mounted thereon, said workpiece holding member having releasable clamping means associated therewith for releasably holding said workpiece;

a power device for linearly moving said slide member toward the grinding wheel for permitting grinding of said workpiece; and control means for causing said support device to be moved toward said grinding wheel in an intermittent steplike manner in synchronization with the oscillation of said grinding wheel, whereby said grinding wheel will sequentially form a plurality of substantially parallel grooves across said workpiece, which grooves define cutting teeth therebetween.

* * * * *